United States Patent [19]

Coomer

[11] Patent Number: 5,067,257

[45] Date of Patent: Nov. 26, 1991

[54] INJECTION FITTED BOOT LINER

[76] Inventor: Sven Coomer, P. O. Box 1929, 6175 Minaret Rd., Mammoth Lakes, Calif. 93546

[21] Appl. No.: 599,683

[22] Filed: Oct. 18, 1990

[51] Int. Cl.[5] ..... A43B 7/14

[52] U.S. Cl. ..... 36/93; 36/88; 36/117

[58] Field of Search ..... 36/117, 118, 119, 120, 36/121, 55, 93, 88, 89, 91, 43, 44

[56] References Cited

U.S. PATENT DOCUMENTS

| | | | |
|---|---|---|---|
| 3,786,580 | 1/1974 | Dalebout | 36/93 |
| 4,182,056 | 1/1980 | Dalebout | 36/117 |
| 4,408,402 | 10/1983 | Looney | 36/91 X |

FOREIGN PATENT DOCUMENTS

| | | | |
|---|---|---|---|
| 0626793 | 12/1981 | Switzerland | 36/117 |

*Primary Examiner*—Paul T. Sewell
*Assistant Examiner*—Beth Anne C. Cicconi
*Attorney, Agent, or Firm*—William H. Maxwell

[57] ABSTRACT

A protective liner custom fitted by low pressure fluid injection over a wearer's anatomy, by permeation of select areas of porous padding, surrounding areas of nonporous padding, with an impervious membrane occluding portions of the porous padding to control fluid resin penetration, and with scarfed abuttment of padding for gradual softness variation; including a method by which a pair of liners are simultaneously injected with fluid resin while the wearer's anatomy is in place, for hardening of the fluid resin and of the permeated padding.

24 Claims, 3 Drawing Sheets

INJECTION FITTED BOOT LINER

BACKGROUND OF THE INVENTION

This invention relates to shoes and boots, and particularly to ski boots and the like. And, it is the anatomy of the foot and lower leg that is to be fitted to, it being a general object of this invention to custom fit each piece of footwear to an individual's foot, according to his or her requirements. That is, according to the use to which the footwear is to be subjected, as for example to be used for walking, running, hiking, skating and skiing, or any other such special use, activity or sport.

PRIOR ART

It is known that several foam, resin or wax injection systems have been available to skiers for fitting ski boots. These systems have the objective of creating specifically molded paddings to each foot and ankle. However, such systems have been plagued with shortcomings in design, using dangerous and difficult to handle chemicals and procedures resulting in experiences that have discouraged ski shops from offering the badly needed custom fitting services to their customers. For example, the foam injection system of Tessaro U.S. Pat. No. 3,769,392 wherein the chemicals are volatile and toxic, and there is difficulty in properly mixing and controlling the quality of the foam materials without the use of elaborate and expensive equipment. There is also extreme heat and pressure against the feet due to chemical reaction and expansion which makes it impossible to control or balance the flow of the material into the boots or the proper alignment of the feet within the boot shell. The shells are distorted and pushed away from the feet. And, the shells must be designed so that they do not leak or explode during the injecting process, which limits their design and the areas of the feet and lower legs which they can support. Consequently, the shells and/or liners have been designed so that support depends entirely on the injected foam or resin properties. This dependence also creates frequent failures, and so that quality and durability cannot be predicted or maintained.

A significant problem with prior art systems is that the feet have depended entirely on the injected foam or resin to serve as and including protective, insulative, supportive and comfort padding, which has been a compromise. Therefore, failures in the prior art are common.

With the present invention the user does not depend entirely upon the injected fluid for comfort and support, but rather for its selective implementation in augmenting the pre-padding materials with respect to the external structural materials of the shell, all of which solves the previous unsolved problems. That is, previous resin and wax injection systems using high injection pressures are avoided, which are too severe for the customer who can also be burned due to excessive heat, or by the bursting of bladders of hot resin.

OBJECTIVES OF THE INVENTION

Footwear, referred to herein as a boot, is characterized by an underlying sole and heel, and by an upper or shell that forms a chamber shaped closely to the configuration of a person's foot, there being a closure that captures the foot within the chamber. However, each person's foot has its peculiar configuration to which it is virtually impossible to exactly manufacture a piece of footwear. Therefore, it becomes necessary to custom fit footwear especially athletic boots such as ski boots and the like. Accordingly, it is an object of this invention to provide the interior of the upper or shell with a padding and supplement material and injection system therefor, to be implemented within the upper or shell as circumstances require. The general construction of the footwear is conventional except for the incorporation of certain features involving the interior liner, all as hereinafter described.

Heretofore, custom fitted footwear has involved analysis and problem solving, resulting in arbitrary fitting which may or may not be correct and comfortable to the wearer. Most often there are discrepancies that cannot be readily corrected. Therefore, it is an object of this invention to provide a versatile system of customizing boots to the exact configuration of the foot and lower leg, by means of cavities injected with a specified quantity of fluid material depending upon the boot size the individual's foot displacement, that solidifies into a pliable shock absorbing layer. In practice, a plastic material is injected into the shell of the boot to fill and occupy space therein, as may be required. Accordingly, it is an object of this invention to provide a liner within the shell that includes at least one cavity adapted to receive fluid material that inherently interfaces with the foot configuration where it is applied. There are significant portions of the foot that require special attention, as will be described.

Prior art footwear, whether off-the-shelf or customized, is subject to non-uniformity with respect to foot anatomy, in that boots are most often found to have hard and soft spots or areas that do not properly fit. These discrepancies are due to difficulty in proper analysis and/or execution of the article in the application of padding etc.. Therefore, it is an object of this invention to provide a form fitting material that is applied hydraulically and which subsequently solidifies into a pliable shock absorbing layer that protects the wearer. In practice, a non-toxic silicon is injected into a liner bladder so as to form fit its cavity to the natural anatomical configuration of that portion of the foot which it interfaces with. The pliable plastic layer thus formed is also a heat insulator.

The prior art practice of individually customizing boots is replaced herein by a system by which all fitted portions of the boot are simultaneously injected with form fitting hydraulic fluid. Therefore, it is an object of this invention to provide a hydraulic injection system and injectable bladders which are form fitting in one single operation, in low pressure equilibrium, and while the wearer assumes the foot posture and/or condition of intended use. Subsequent to the fluid injection the form fitted material solidifies in place and is ready for use. Among those areas of the foot and lower leg to which these bladders are applied is mainly the lower third of the lower leg, the ankle, the heel, the instep and the arch, and the shin at the tongue of the boot. It is also an object of this invention to simultaneously inject both right and left boots in one injection operation, with a measured quantity of fluid depending upon foot size and boot volume, precisely stabilizing the low injection pressure during solidification.

SUMMARY OF THE INVENTION

There is provided a shoe or boot liner incorporating a sealed cavity or cavities and a normal amount of functionally supportive and protective padding, so that a pourable fluid resin may be mixed and injected simultaneously into said cavities of the pair of shoes or boots through a single source, allowing the user to then insert both feet to displace the excess fluid resin and so that it flows freely to fill all of the pourous foams and remaining voids and thereby create a completely uniform definition of the user's feet. The respective cavities of pairs of shoes or boots are connected by the injection tubes and those bladder cavities containing protective paddings incorporate select and specially tailored and positioned foams, some porous and some non-porous, the porous foams when saturated by the injected fluid resin reacting so as to solidify to selected hardness or softness as may be required. This results in form fitting layers of protective material that is comfortable to that particular individual wearer. A feature is the low displacement pressure just prior to solidification, whereby the custom fit is devoid of any applied pressure.

The foregoing and various other objects and features of this invention will be apparent and fully understood from the following detailed description of the typical preferred forms and applications thereof, throughout which description reference is made to the accompanying drawings in which:

THE DRAWINGS

FIG. 1 is a perspective view showing the system which implements the injection fitted boot lining system of the present invention.

FIG. 2 in an enlarged view of a clamp means employed to control fluid displacement during the injection of resin and catalyst.

PREFERRED EMBODIMENT

This invention employs a controlled low pressure injection system that conditions pre-installed supportive-comfort paddings, so that the wearer is provided with optimum protective support and comfort as may be required for the sporting activity involved.

Figures 1, 2:
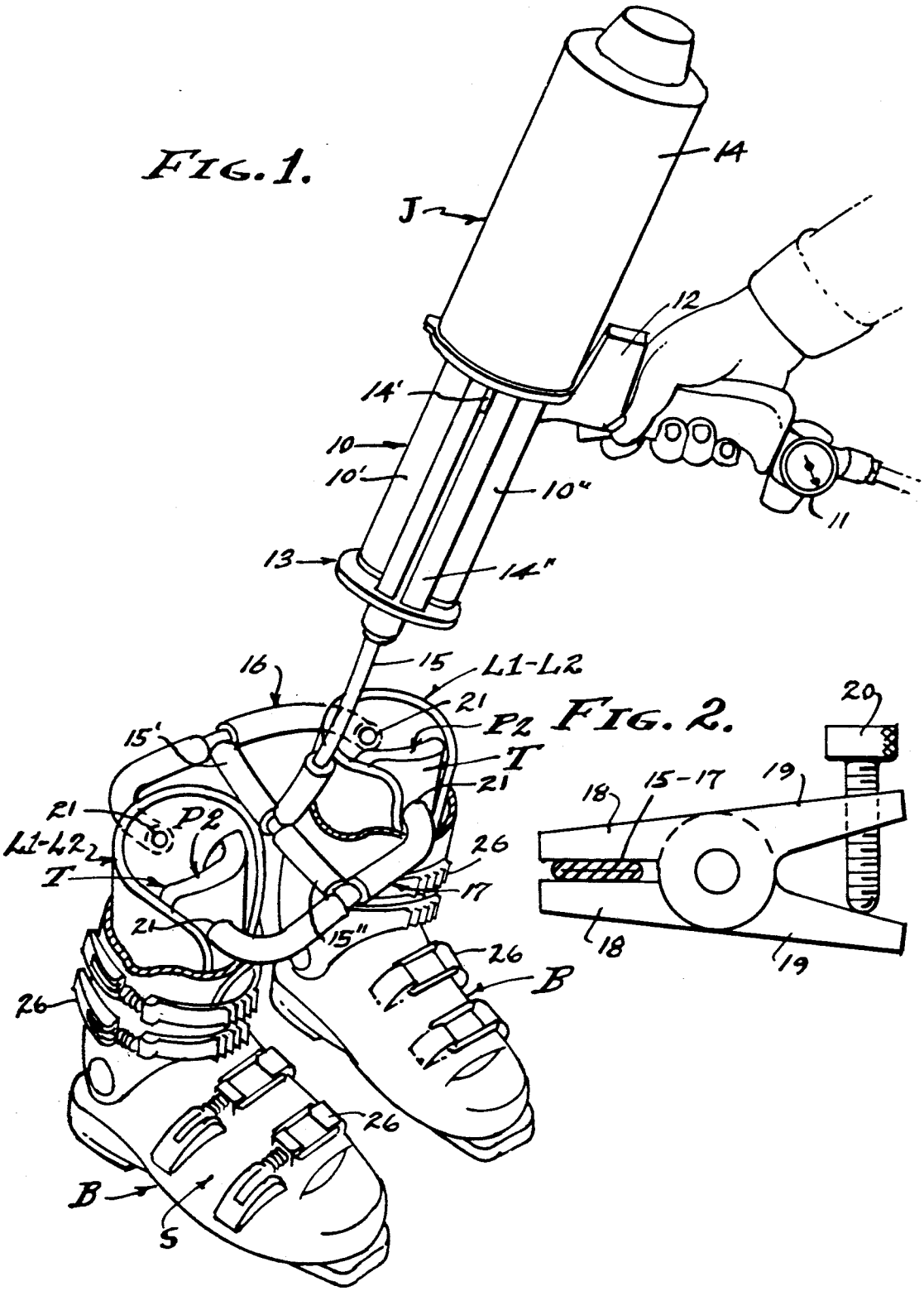

Referring now to the drawings, FIG. 1 illustrates the preferred implementation of the injection system and its simultaneous application to a pair of ski boots B—B. The injection system involves, generally, a fluid injection apparatus J comprised of a pneumatically powered displacement device wherein a double barrel cartridge 10, having a barrel 10' containing resin and a barrel 10'' containing catalyst, is replaceable in a receptacle 13 and subject to proportional delivery of said resin and combined and admixed catalyst. A power cylinder and piston means 14 reciprocates a plunger 14' that simultaneously engages with pistons (not shown) in said cartridge to discharge them together as required. A feature is a visible part of the plunger 14' revealing the travel thereof and thereby indicating the volume of discharge through a tube or hose 15 and into the bladder or bladders as will be described.

The injection of the boot bladders is simultaneous as clearly shown, into the posterior and anterior tube extensions 16 and 17, hoses in open communication with the hose 15 by means of a "Y" or "T" extension 15' and 15''. A feature of this system is the selection and precise measured quantity control of fluid injection into the posterior and anterior portions of the boots. This flow control is by selective closure of the hose extensions 15' and 15'' by clamp means C (see FIG. 2). The clamp means C involves jaws, preferably opposed pincer jaws 18 operated by levers 19 separated by a manually operable screw 20. In practice for example, a Vice-Grip (TM) type pliers can be employed, simply applied over the tube extensions 15' and 15'' to be closed, as may be required. Suitable fittings are employed to interconnect the tubes and hoses, as shown, and they are releasably coupled into the interior bladder cavities of the liners L1 and L2, or tongue T, as by coupler means 21. A feature of the hydraulics is that there is open communication between the boots B—B and injection hose 15, whereby equalization of liquid resin and catalyst is ensured when the wearer's feet are secure by closures and in working position.

Figure 3:
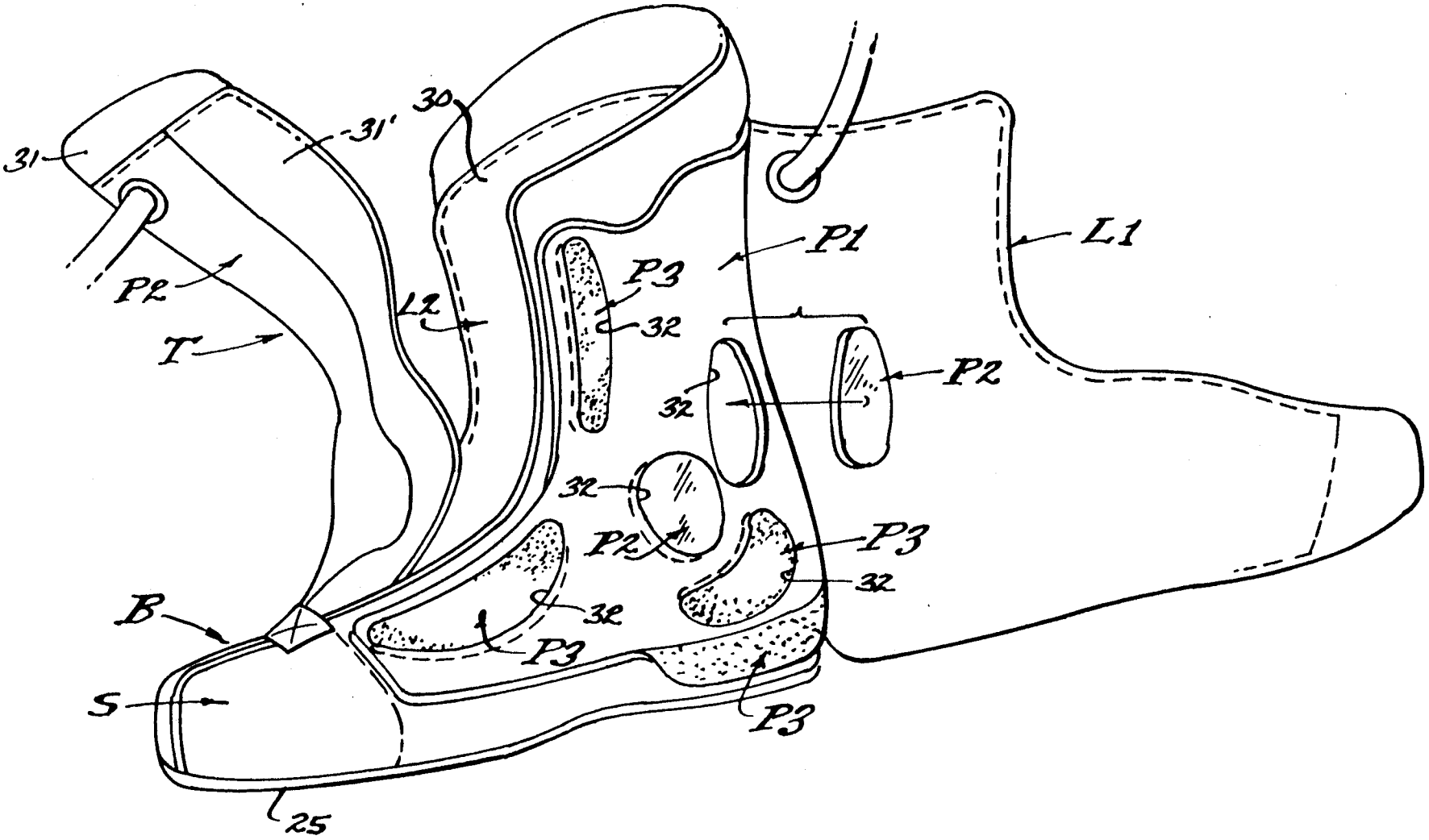
FIG. 3 is an enlarged perspective view of a boot embodying the features of the present invention, with a side portion of the boot shell removed, and with a side portion of the outer liner peeled back, and the tongue pulled forward.

Referring now to FIG. 3 of the drawings, a boot B is shown comprised of a sole 25 carrying an upper or shell S with a tongue, all of which is secured by a closure means 26 (see FIG. 1). It is normal practive to make the upper or shell S and exterior of the tongue T, rugged, stiff and durable, and consequently not conducive to form fitting to the contours of the wearer's foot. Consequently, interior linings are commonly employed and which are designed to more or less accomodate variations in foot anatomy. Therefore, and in order to avoid compromise, the lining of the present invention involves, generally, a durable outer liner L1 and a supple inner liner L2, and an intermediate moderately soft padding P1.

In accordance with this invention, there is at least one first pad of discriminately soft padding P2 to interface with a portion of the foot anatomy to be protected. Further, and in accordance with this invention, there is the fluid resin injection means J by which the liners L1 and L2 conform precisely to the anatomical contours of the foot closed within the boot B. Still further and in accordance with this invention, there is at least one second pad of permeable soft padding P3 to interface with a portion of the foot anatomy requiring firmness.

The outer liner L1 and the exterior of the tongue T are of usual construction and of rugged, rather stiff and durable material that establishes the boot configuration adapted to the sporting activity involved, in this case a ski boot. The outer liner L1 and exterior of the tongue T are made of heavy leather or plastic equivalent, and of substantial thickness.

The inner liner L2 within the outer liner L1 and the liner L2 of tongue T are all of a supple material adapted to readily conform to the anatomical configuration of the foot of any particular wearer of the boot, it being that particular wearer to which the boot is customized. In practice, the outer and inner liners L1 and L2 form a bladder sealed at its periphery and comprised of a side to side portion 30 that wraps around and lies within and is substantially coextensive with the inside of the shell S, except for the tongue opening. The inside portions 30, and 31 of the tongue, are made of supple leather or a plastic material equivalent. The margins of the liner portions 30 and 31 of the tongue T are bonded and sealed at complementary margins thereof, thereby establishing a bladder in each instance, a closed chamber open only to the injection hoses 16 and 17. There is a closed chamber or cavity within each liner bladder.

Figure 6:
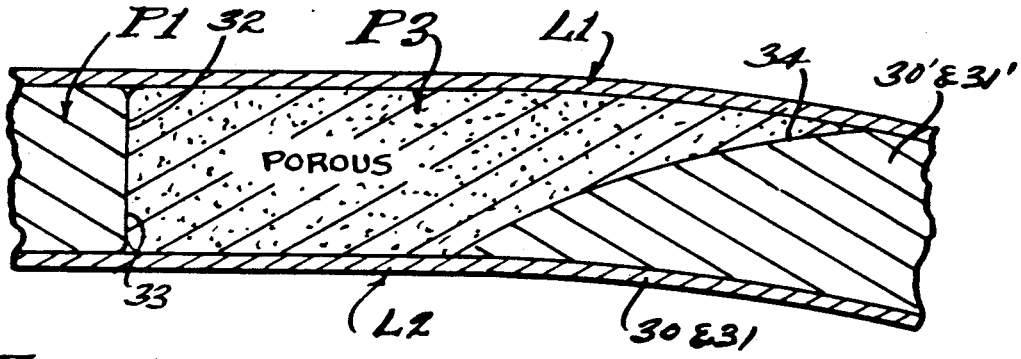
Figure 7:
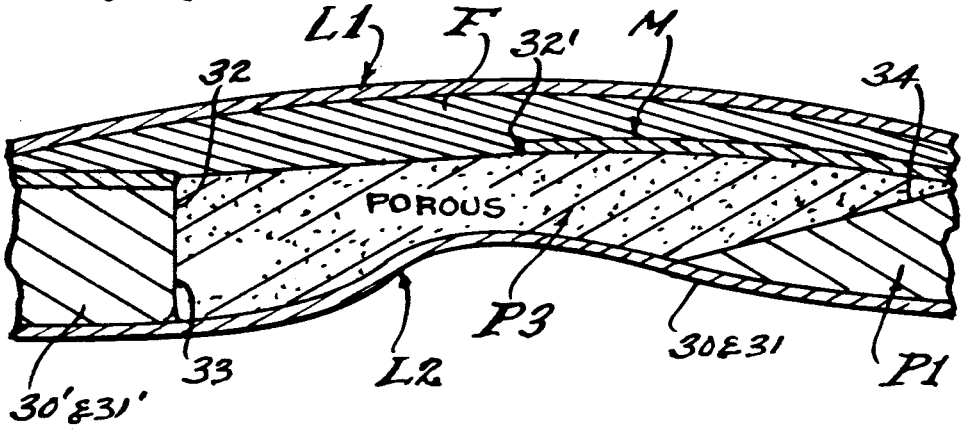

Within the bladder formed by the outer and inner liners L1 and L2 there is the intermediate and coextensive moderately soft padding P1. In practice, the padding P1 is applied to the inner liner L2 as shown in FIGS. 3 and 7, and occupies the extent of the bladder interior, and is of substantial thickness as may be required, for example one quarter inch thick. The softness of padding P1 is moderate and the material thereof is non porous so as to prevent permeation and any change in the physical properties thereof, as by fluid injection of liquid resin F. Such a nonporous material is Ethyl Vinyl Acetate as manufactured by Clerprem S.P.A. of Maser, Italy. In accordance with this invention, the padding portions 30' and 31' have free-form openings 32, each with a perimeter conforming to and overlying a contiguous part of the foot anatomy to be protected. For example, the openings 32 are complementary to areas overlying the ankles and shin bones, arteries, nerve ends, and over the active achilles and anterior tibial tendons. As shown, the openings 32 have normal right angular walls 33 and/or scarfed walls 34, as may be required (see FIGS. 5-7). The opening 32 is shaped to receive pads P2 and P3 of complementary shape as next described.

Figure 5:
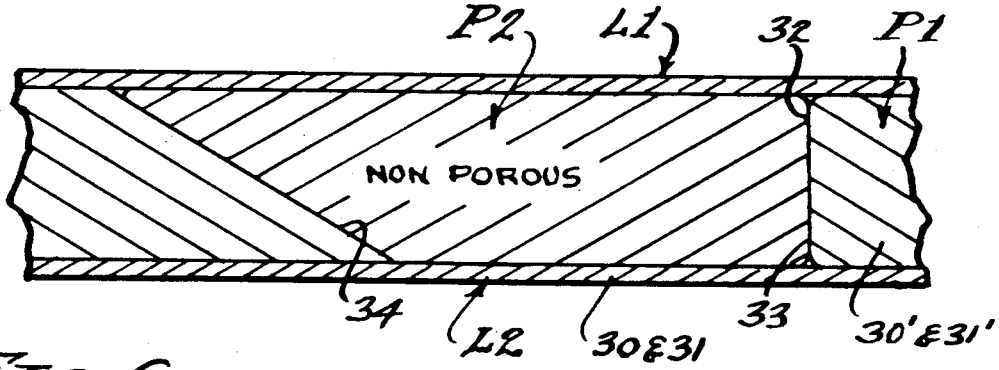

The pads P2 are discriminately soft pads of nonporous foam material, the same as the padding P1, so as to be impermeable without change to physical properties by fluid injected resin F. In carrying out this invention, the softness requirement contiguous to any one of the anatomical areas of the foot can vary, either softer or firmer than the padding P1. Accordingly, softer or firmer pads P2 are selected as may be required, said pads retaining softness selected. A feature of this invention is the controlled transition of one softness to another, between the adjacent foam material of padding P1 and of the inserted pad P2. Referring to FIG. 5, the pad P2 is abutted to wall 33 of opening 32 whereby a sharp change in softness occurs. However, the scarfed engagement at 34 establishes a gradual transition of softness.

The pads P3 are permeable soft pads of porous foam material for modified softness by means of permeation by the fluid injection of the resin F. In carrying out this invention, firmness of pads P3 is increased contiguous to any one of the anatomical areas requiring that protection as distinguished from a fixed softness. To this end end the pads P3 are made of permeable porous material such as recycled polyurethane known as "AGGLOMERATO" manufactured by SPAC of Montebelluna, Italy. For example, the heel bone and forefoot are to be protected by hardening of the liner, namely hardening of the porous foam material of pad or pads P3, whereby a pliable shock absorbing layer of flexible resin is permanently shaped to the foot anatomy.

In accordance with this invention, the firmness and transition thereof into the pad P3 is controlled between the adjacent padding material of padding P1 and the inserted pad P3. Referring to FIGS. 6 and 7, the pad P3 is abbutted to wall 33 of opening 32 whereby a sharp change in firmness occurs. However, the scarfed engagement at 34 provides a gradual transition of firmness. Increased firmness of porous pad P3 is my means of its permeation with injected liquid resin F. In FIG. 6 the entire pad P3 is permeated. In FIG. 7 a controlled portion of the pad P3 is permeated while the scarf 34 gradually changes firmness to softness in the transition from pad P3 to padding P1.

The aforementioned control over firmness in pad P3 is by means of a membrane M prepared with an opening 32' of reduced area with respect to the opening 32 that it overlies, whereby a portion of exposed interface of pad P3 is reduced (see FIG. 7). The membrane M is a film such as Mylar or Coagulated Polyurethane as manufactured by LORICA of Cornuda, Italy. As shown, the scarfed portion 34 of pad P3 is occluded by the film of membrane M. Volume control, by means of the visable plunger 14', determines resin penetration.

The preferred injection fluid is a resin similar to or the same as a dental impression silicon rubber such as PR-806 manufactured by Polymer Research Corporation, of Glendale, Calif., a material that is easy to mix thoroughly, with little or no exothermic heat, little or no shrinkage, and completely safe to handle and for the user to wear. This material also reacts with the bonding agent within the aforementioned recycled foam, namely the AGGLOMERATO and which is used for saturating selected areas to be hard molded, as hereinabove described. Once the prescribed amount of the two part resin is mixed so as to react chemically, a pourable liquid is established that will seek its way throughout the pads within the bladder to be filled at very low pressure of injection. Injection of the fluid F is either before or during insertion of the wearer's foot, and preferably when a pair of boots is worn so that a fluid quantity settles evenly between the boots and inherently in equilibrium that automatically balances the overall fluid pressure. The wearer settles each foot through manipulation, as by pulling up of the tongues T and by adjusting the closure means 26 to his or her liking and comfort. This adjustment is to use condition and/or posture.

Referring to FIG. 3 of the drawings, the external shell S of the ski boot is removed and the outer liner L1 has been peeled back and the tongue T has been pulled forward. Pre selected pads P2 and P3 of the desired properties are strategically placed, softer non-porous foam pads P2 and firmer porous foam pads P3. For example, the foam pads P2 made of Ethyl Vinyl Acetate, and the pads P3 made of recycled foamed Polyurethane. The pads P2 and P3 are tailored to fit into the complementary shaped openings 32 in the padding P1, said openings being strategically cut out to receive said pads during fabrication of the boot liner. For example, the softer nonporous foam pads P2 overlie the ankles and shin bones, arteries, nerve ends, and over the active anchilles and anterior tibial tendons; while the firmer porous pads P3 are placed to receive injected fluid so as to become harder and molded to the anatomical shapes that they overlie, such as the heel bone and the forefoot where stability is crucial. These protected areas are characteristic of ski and skate boots.

Figure 4:
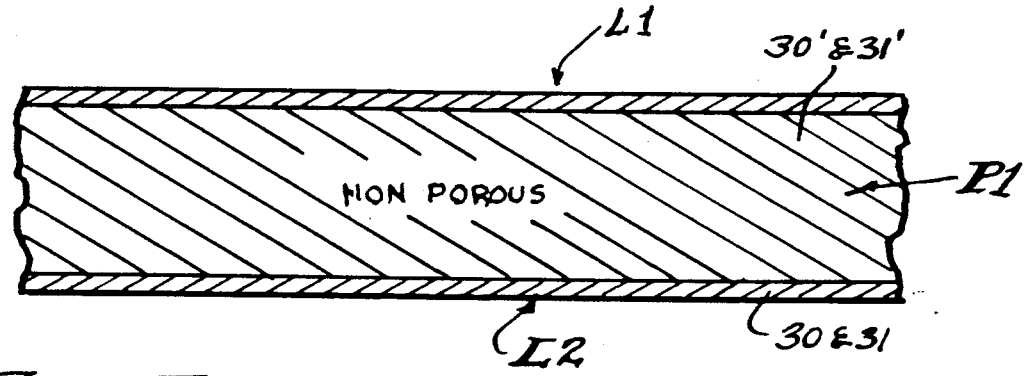
FIGS. 4 through 7 are enlarged sectional views illustrating the bladder comprised of outer and inner lining and intermediate pad relationship of the present invention, FIG. 4 showing the basic relationship, FIG. 5 showing the insertion of a discriminately soft non-porous pad, FIG. 6 showing the insertion of a porous pad, and FIG. 7 showing the dynamics of fluid injection of the resin material.

Referring to FIG. 4 of the drawings, there is a non permeable foam padding P1 disposed between the outer liner L1 and inner liner L2, all within a bladder formed thereby in combination.

Referring to FIG. 7 of the drawings, there is a resin fluid injected to partially permeate the foam pad P3 and which seeps to a limited extent under the barrier membrane m as shown. The bladder formed by the exterior liner and interior liner seals the foam from exposure. The wearer's foot is inserted into the boot and the resin fluid F injected into the bladder so as to permeate the foam pads P3, to be shaped by the anatomy of the foot, governed by the displacement and seepage of fluid into all of the available spaces and interstices, and gradually tapering into the limits of penetration. This eliminates the risk of potentially hard and uncomfortable edges between the permeable foam and the non permeable foam. The fluid resin F seeks its own volume requirement within the liners L1 and L2, whereupon the resin gels and/or cures, creating in this way a complementary fit with the anatomical shape of the wearer's foot.

In accordance with this invention, the shell S and outer liner L1 can be integrally formed as a single layer of material, rather than laminated as shown and hereinabove described. That is, the inner liner L2 can be directly bonded to the shell S at its periphery with the pads P1, P2 and P3 disposed therebetween.

In practice, the fluid F is formulated so as to allow time for adjustment and closure, for example five minutes, followed by another three or four minutes for flexing and rolling the wearer's feet, so as to ensure fluid movement and its liberal placement as hereinabove described. At the end of this prescribed time, the boots are ready for use or removal for subsequent use by that particular person to whom they have customized.

Having described only the typical and preferred forms and applications of my invention, I do not wish to be limited or restricted to the specific details herein set forth, but wish to reserve to myself any modifications or variations that may appear to those skilled in the art, as set forth within the limits of the following claims.

I claim:

1. A protective boot liner for custom fitting to a wearer's anatomy by means of fluid resin injection and its subsequent solidification and including;

a boot shell worn over the wearer's anatomy to be protected and shaped to the general configuration of said anatomy, an inner liner within the boot shell and coextensive with at least one anatomical area to be protected and forming a bladder for the reception of fluid resin, and a layer of nonporous padding coextensive with the inner liner and disposed within the bladder between the shell and the inner liner and impermeable to said fluid resin and having at least one opening at a select area of said anatomy, there being fluid resin injection means to fill the bladder surrounding the padding and over said opening in the padding, thereby inflating the bladder and contiguously engaging the inner liner with the wearer's anatomy and to set thereat by subsequent solidification.

2. The protective boot liner as set forth in claim 1, wherein a second layer of padding of different softness than the first mentioned layer of padding is fitted into the opening in said first mentioned layer of padding.

3. The protective boot liner as set forth in claim 2, wherein the first and second mentioned layers of padding are fitted together by a right angular walls of one abutted against the other for abrupt softness variation.

4. The protective boot liner as set forth in claim 2, wherein the first and second mentioned layers of padding are fitted together by angularly scarfed walls of one abutted against the other for gradual softness variation.

5. The protective boot liner as set forth in claim 1, wherein a second layer of porous padding is fitted into the opening in the first mentioned layer of padding to be permeated by fluid resin and hardened thereby.

6. The protective boot liner as set forth in claim 1, wherein a second layer of porous foam padding is fitted into the opening in the first mentioned layer of padding to be permeated by fluid resin and hardened thereby.

7. The protective boot liner as set forth in claim 5, wherein an impervious membrane overlies and reduces the size of the opening in the first mentioned padding and occludes a part of the second mentioned padding fitted therein to restrict the permeation of fluid resin therein.

8. The protective boot liner as set forth in claim 1, wherein a second layer of porous padding is fitted into the opening in said first mentioned layer of padding, wherein the first and second mentioned layers of padding are fitted together by angularly scarfed walls of one abbuted against the other for gradual softness variation, and wherein an impervious membrane overlies and reduces the size of the opening in the first mentioned padding and occludes at least a portion of said scarfed abuttment to restrict the permeation of fluid resin therein.

9. A protective boot liner for insertion into and custom fitting to a wearer's anatomy by means of fluid resin injection and its subsequent solidification and including;

an outer liner for insertion into a boot shell worn over the wearer's anatomy to be protected and shaped to the general configuration of said anatomy, an inner liner complementary to and within the outer liner and sealed therewith forming a bladder coextensive with at least one anatomical area to be protected and for the reception of fluid resin, and a layer of nonporous padding coextensive with the inner liner and disposed within the bladder between the outer liner and the inner liner and impermeable to said fluid resin and having at least one opening at a select area of said anatomy, there being fluid resin injection means to fill the bladder surrounding the padding and over said opening in the padding, thereby inflating the bladder and contiguously engaging the outer liner with said boot shell and the inner liner with the wearer's anatomy and to set thereat by subsequent solidification.

10. The protective boot liner as set forth in claim 9, wherein a second layer of padding of different softness than the first mentioned layer of padding is fitted into the opening in said first mentioned layer of padding.

11. The protective boot liner as set forth in claim 10, wherein the first and second mentioned layers of padding are fitted together by a right angular walls of one abutted against the other for abrupt softness variation.

12. The protective boot liner as set forth in claim 10, wherein the first and second mentioned layers of padding are fitted together by angularly scarfed walls of one abutted against the other for gradual softness variation.

13. The protective boot liner as set forth in claim 9, wherein a second layer of porous padding is fitted into the opening in the first mentioned layer of padding to be permeated by fluid resin and hardened thereby.

14. The protective boot liner as set forth in claim 9, wherein a second layer of porous foam padding is fitted into the opening in the first mentioned layer of padding to be permeated by fluid resin and hardened thereby.

15. The protective boot liner as set forth in claim 13, wherein an impervious membrane overlies and reduces the size of the opening in the first mentioned padding and occludes a part of the second mentioned padding fitted therein to restrict the permeation of fluid resin therein.

16. The protective boot liner as set forth in claim 9, wherein a second layer of porous padding is fitted into the opening in said first mentioned layer of padding, wherein the first and second mentioned layers of padding are fitted together by angularly scarfed walls of one abutted against the other for gradual softness variation, and wherein an impervious membrane overlies and reduces the size of the opening in the first mentioned padding and occludes at least a portion of said scarfed abutment to restrict the permeation of fluid resin therein.

17. A protective boot liner and method for custom fitting to a wearer's anatomy by means of fluid resin injection and its subsequent solidification and including;

applying a boot shell to and to be worn over the wearer's anatomy to be protected and shaped to the general configuration of said anatomy, inserting an inner liner within the boot shell and coextensive with at least one anatomical area to be protected and forming a bladder for the reception of fluid resin, disposing a layer of nonporous padding coextensive with the inner liner and within the bladder between the shell and the inner liner and impermeable to said fluid resin and having at least one opening at a select area of said anatomy, and injecting fluid resin at a low pressure to fill the bladder surrounding the padding and over said opening in the padding to sufficiently inflate the bladder and contiguously engage the inner liner with the wearer's anatomy and to set thereat by subsequent solidification.

18. The protective boot liner and method as set forth in claim 17, wherein a second layer of porous padding is fitted into the opening in the first mentioned layer of padding to be permeated by fluid resin and hardened thereby.

19. The protective boot liner and method as set forth in claim 17, wherein the method is conducted with said wearer's anatomy in place within the inner liner.

20. The protective boot liner and method as set forth in claim 17, wherein the method is conducted with a pair of boot liners simultaneously with the wearer's anatomy in place within the inner liners thereof.

21. A protective boot liner and method for custom fitting to a wearer's anatomy by means of fluid resin injection and its subsequent solidification and including;

inserting an outer liner into a boot shell applied to and to be worn over the wearer's anatomy to be protected and shaped to the general configuration of said anatomy, inserting an inner liner complementary to and within the outer liner and sealed therewith forming a bladder coextensive with at least one anatomical area to be protected and for the reception of fluid resin, disposing a layer of nonporous padding coextentsive with the inner liner and within the bladder and impermeable to said fluid resin and having at least one opening at a select area of said anatomy, and injecting fluid resin at a low pressure to fill the bladder surrounding the padding and over said opening in the padding to sufficiently inflate the bladder and contiguously engage the outer liner with said boot shell and the inner liner with the wearer's anatomy and to set thereat by subsequent solidification.

22. The protective boot liner and method as set forth in claim 21, wherein a second layer of porous padding is fitted into the opening in the first mentioned layer of padding to be permeated by fluid resin and hardened thereby.

23. The protective boot liner and method as set forth in claim 21, wherein the method is conducted with said wearer's anatomy in place within the inner liner.

24. The protective boot liner and method as set forth in claim 21, wherein the method is conducted with a pair of boot liners simultaneously with the wearer's anatomy in place within the inner liners thereof.

* * * * *